US008717122B2

(12) United States Patent
Wong

(10) Patent No.: US 8,717,122 B2
(45) Date of Patent: May 6, 2014

(54) CAVITY FILTER

(75) Inventor: Kwo-Jyr Wong, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 582 days.

(21) Appl. No.: 12/966,092

(22) Filed: Dec. 13, 2010

(65) Prior Publication Data

US 2012/0019337 A1 Jan. 26, 2012

(30) Foreign Application Priority Data

Jul. 23, 2010 (CN) ..... 2010 2 0269785 U

(51) Int. Cl.
*H01P 1/205* (2006.01)
*H01P 7/00* (2006.01)

(52) U.S. Cl.
USPC ..... 333/202; 333/235

(58) Field of Classification Search
USPC ..... 333/202–203, 208–209, 212, 219, 227, 333/231–233, 235
See application file for complete search history.

(56) References Cited

U.S. PATENT DOCUMENTS 5,847,627 A * 12/1998 Radzikowski et al. ..... 333/202
2009/0058563 A1 * 3/2009 Seo et al. ..... 333/209

* cited by examiner

*Primary Examiner* — Benny Lee
*Assistant Examiner* — Rakesh Patel
(74) *Attorney, Agent, or Firm* — Novak Druce Connolly Bove + Quigg LLP

(57) ABSTRACT

A cavity filter includes a housing, a plurality of resonators received in the housing, a cover covering the opening, a sliding plate, and a plurality of tuning posts. The housing defines an opening and comprises at least one pair of positioning portions. The plurality of tuning posts are fixed in the cover corresponding to the plurality of resonators. The sliding plate is disposed between the cover and the plurality of resonators, and is slidably positioned at the at least one pair of positioning portions. The sliding plate comprises a plurality of tuning cells and at least one elastic arm. The plurality of tuning cells is coated with a metallic layer and corresponds to the plurality of resonators. The at least one elastic arm extends from the sliding plate and elastically resists the cover.

10 Claims, 7 Drawing Sheets

CAVITY FILTER

BACKGROUND

1. Technical Field

The present disclosure relates to cavity filters, and more particularly relates to a tuning structure of a cavity filter.

2. Description of Related Art

Cavity filters are popular in mobile communications. Generally, a cavity filter includes a housing, a cover, a sliding plate, and a plurality of resonators. The housing defines an opening at a top of the housing. The resonators are securely received in the housing and the cover covers the opening. The housing includes a positioning portion adjacent to the opening. The sliding plate includes a plurality of tuning cells coated with a metal layer corresponding to the resonators. The sliding plate is movably disposed between the cover and the resonators, and slides on the positioning portion to adjust the frequency of the cavity filter. A gap is defined by the sliding plate related to the cover to avoid generating spark from the contact of the sliding plate and the cover. In use, the sliding plate slides relative to the cover and the resonators are driven by a driving device to adjust the resonating frequency of the cavity filter.

However, the sliding plate is prone to float upward while sliding due to the gap, so it is difficult to adjust the resonating frequency of the cavity filter accurately.

Therefore, there is room for improvement within the art.

BRIEF DESCRIPTION OF THE DRAWINGS

The components in the drawings are not necessarily drawn to scale, the emphasis instead being positioned upon clearly illustrating the principles of the present disclosure. Moreover, in the drawings, like reference numerals designate corresponding parts throughout the views.

DETAILED DESCRIPTION

Figure 1:
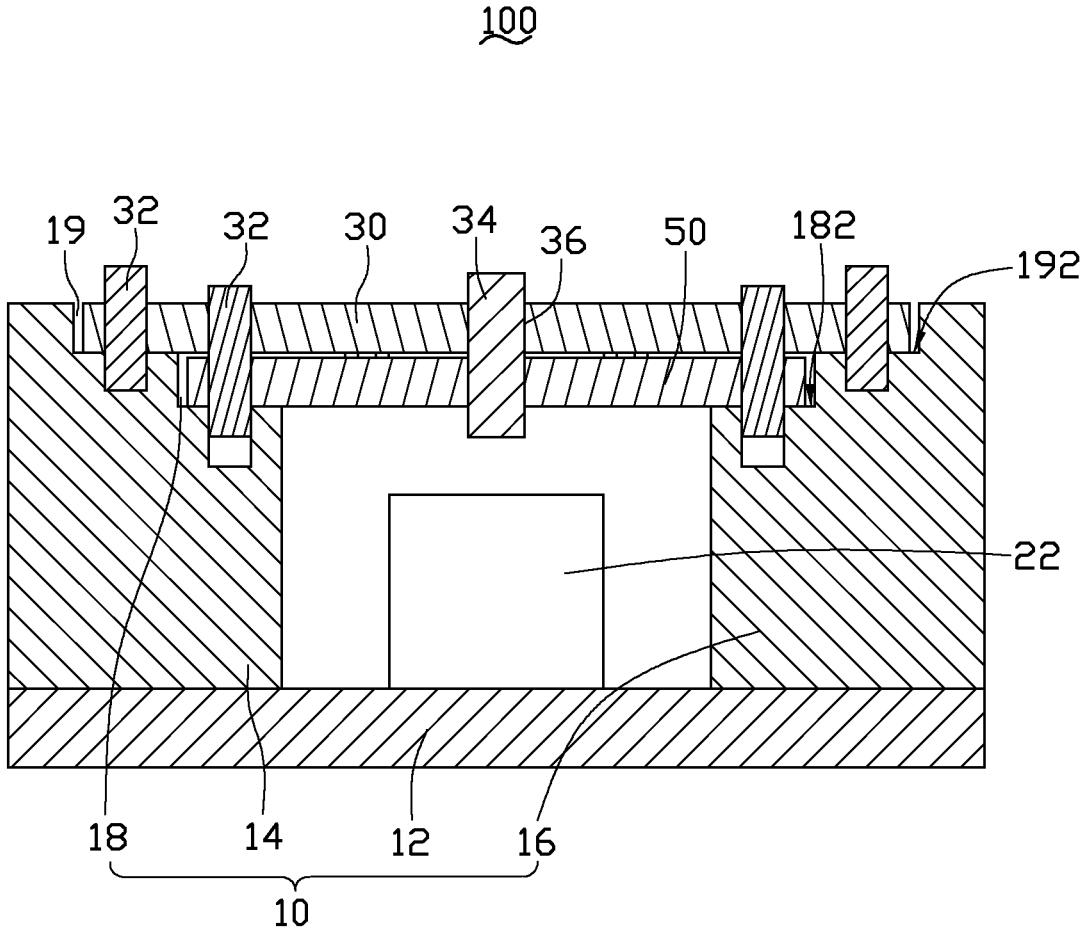
FIG. 1 is a cross-section of a first embodiment of a cavity filter including a housing, a cover, and a sliding plate including a plurality of elastic arms.

Referring to FIG. 1, a first embodiment of a cavity filter 100 includes a housing 10, a plurality of resonators 22, a cover 30, and a sliding plate 50.

The housing 10 includes a baseboard 12, a first sidewall 14, a second sidewall 16, and a pair of positioning portions 18. The baseboard 12 can be substantially rectangular. The first sidewall 14 and the second sidewall 16 respectively extend from opposite edges of the baseboard 12. The housing 10 defines an opening 19 opposite to the baseboard 12. The first sidewall 14 and the second sidewall 16 define two fixing surfaces 192 depressed from distal ends of the first sidewall 14 and the second sidewall 16 adjacent to the opening 19. The pair of positioning portions 18 are two slots respectively depressed from inner surfaces of the first sidewall 14 and the second sidewall 16. In the illustrated embodiment, each positioning portion 18 adjoins the adjacent fixing surface 192. Each positioning portion 18 includes a supporting surface 182 substantially parallel to the baseboard 12. The resonators 22 (only one is shown in FIG. 1) are received in the housing 10 and fixed to the baseboard 12.

The cover 30 covers the opening 19 and abuts the fixing surface 192. The cavity filter 100 further includes a plurality of fasteners 32 and a plurality of tuning posts 34. The fasteners 32 are configured to fix the cover 30 to the first sidewall 14 and the second sidewall 16 of the housing 10. The cover 30 defines a plurality of threaded holes 36 corresponding to the resonators 22. The tuning posts 34 are fixed in the corresponding threaded holes 36 to provide adjustment of the resonating frequency of the cavity filter 100.

Figure 2:
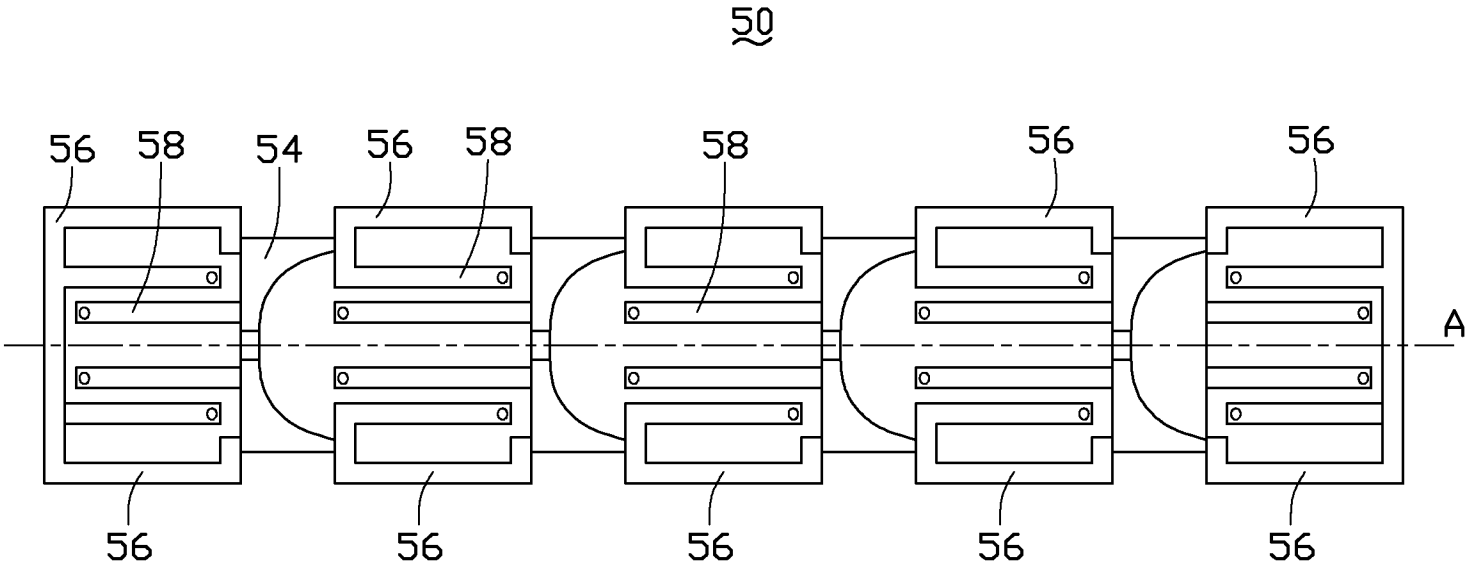
FIG. 2 is a top plan view of the sliding plate of the cavity filter of FIG. 1.

Referring to FIG. 2, the sliding plate 50 includes four tuning cells 54, five pairs of connecting portions 56 and a plurality of elastic arms 58. The tuning cells 54 are coated with a metallic layer. The plurality of tuning cells 54 is connected in series by the five pairs of connecting portions 56, such that each tuning cell 54 is positioned between two pairs of connecting portions 56. In the illustrated embodiment, the sliding plate 50 includes four resonators 22 and four tuning posts 34 corresponding to the four tuning cells 54.

Figure 3:
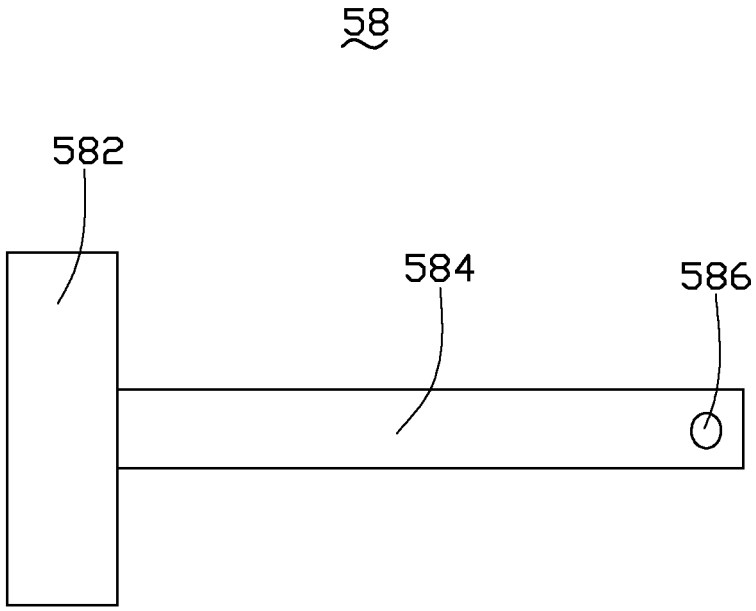
FIG. 3 is a top plan view of an elastic arm of the cavity filter of FIG. 1.
Figure 4:
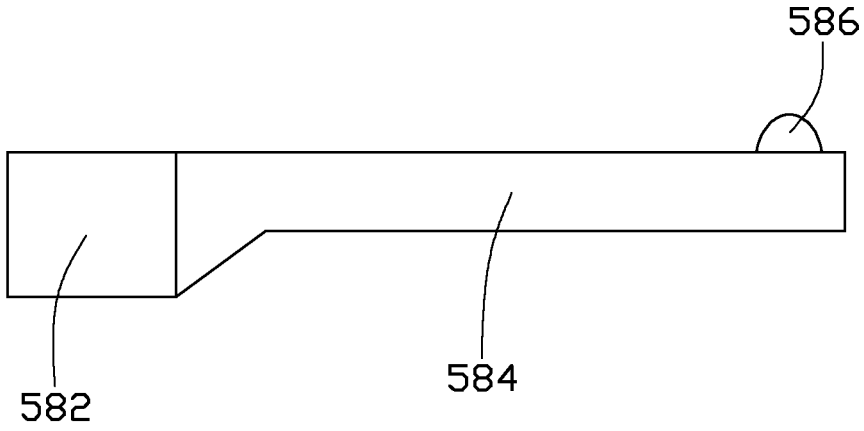
FIG. 4 a side view of the elastic arm of FIG. 3.

Referring to FIG. 3 and FIG. 4, each elastic arm 58 includes a fixing end 582, an arm portion 584, and a resisting end 586. The elastic arm 58 is made of elastic material. The fixing end 582 is fixed to the sliding plate 50. In the illustrated embodiment, the fixing ends 582 of the plurality of elastic arms 58 are selectively fixed to the tuning cells 54 and the connecting portions 56. The arm portion 584 is substantially planar, and extends from the fixing end 582. The resisting end 586 extends from a side surface of the arm portion 584 at an end of the arm portion 584 away from the fixing end 582. In the illustrated embodiment, the sliding plate 50 includes twenty elastic arms 58, wherein the five pairs of connecting portions 56 and twenty elastic arms 58 are distributed symmetrically relative to a line A (shown in FIG. 2) passing through the geometric centers of the four tuning cells 54.

During installation, the sliding plate 50 is received in the housing 10, and the connecting portions 56 at two opposite sides of the line A are at least partly received in the corresponding positioning portions 18. The cover 30 is fixed to the housing 10 by the fasteners 32 to cover the opening 19. The sliding plate 50 is movably disposed between the cover 30 and the resonators 22, the four tuning cells 54 of the sliding plate 50 correspond to the four resonators 22 received in the housing 10, and the resisting ends 586 of the elastic arms 58 abut the cover 30. Each tuning post 34 is received in the corresponding threaded hole 36 of the cover 30.

When changing the resonating frequency of the cavity filter 100, the sliding plate 50 slides along the supporting surface 182 driven by a driving device such as a step motor. The relative positions of the tuning cells 54, the cover 30, and the resonators 22 are changed, thereby changing the capacitance between the cover 30 and the resonators 22 and the resonating frequency of the cavity filter.

The sliding plate 50 when slid, resists the supporting surfaces 182 of the positioning portions 18, and the elastic arms 58 of the sliding plate 50 abut the cover 30, preventing the sliding plate 50 from drifting upwards, thus the resonating frequency of the cavity filter 100 is easily adjusted.

The structure of the elastic arm 58 is relatively simple, whereby the sliding plate 50 may be more easily manufactured. The elastic arms 58 elastically abut the cover 30, such that friction drag between the cover 30 and the sliding plate 50 is decreased and the sliding plate 50 is capable of sliding more smoothly.

The elastic arms 58 are symmetrically distributed relative to the line A passing through the geometric centers of the four tuning cells 54, wherein friction on two sides of the sliding plate 50 may be balanced and relative positions of the tuning cells 54, the cover 30 and the resonators 22 are easily fixed, and the adjustment precision of the cavity filter 100 can be improved.

Figure 5:
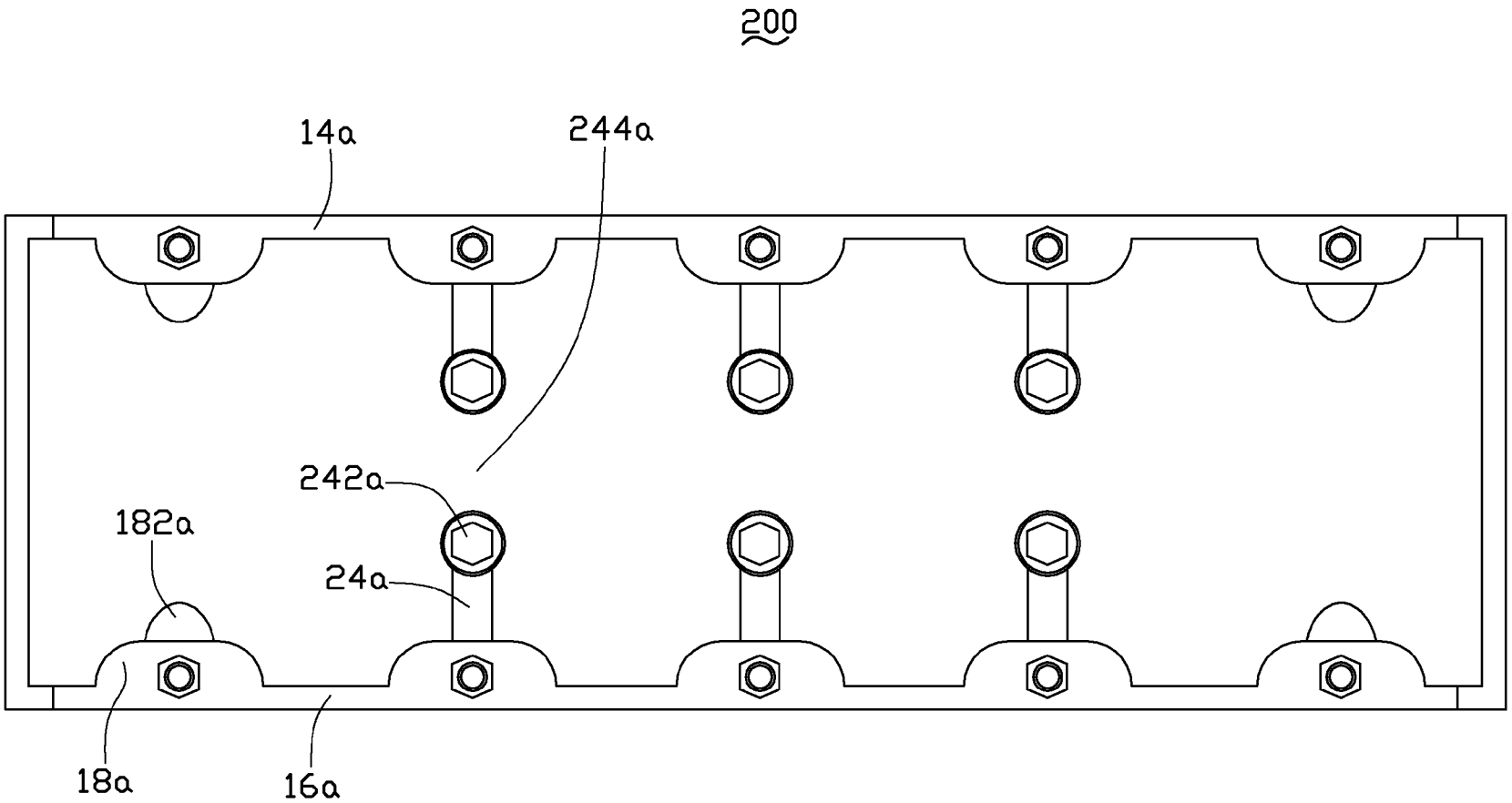
FIG. 5 is a top plan view of a second embodiment of a cavity filter.
Figure 6:
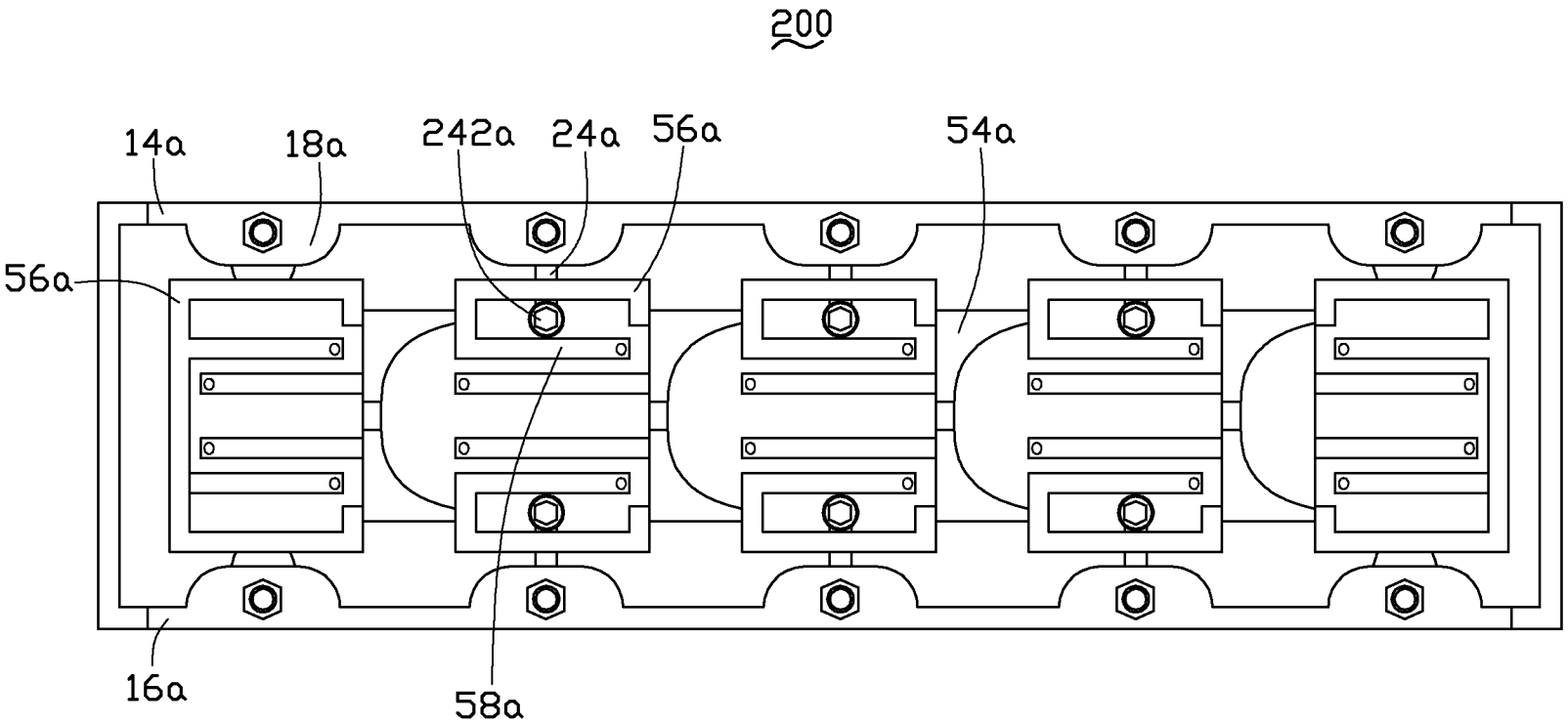
FIG. 6 is an assembled, top plan view of a sliding plate and the housing of the cavity filter of FIG. 5.

Referring to FIG. 5 and FIG. 6, a second embodiment of a cavity filter 200 differs from the first embodiment only in that the positioning portions 18*a* protrude from inner surfaces of the first sidewall 14*a* and the second sidewall 16*a*. Each positioning portion 18*a* defines a supporting surface 182*a* protruding from a top of the positioning portion 18*a*. In the illustrated embodiment, two pairs of positioning portions 18*a* are formed at two opposite ends of the first sidewall 14*a*, and the other two positioning portions 18*a* are formed at opposite ends of the second sidewall 16*a* accordingly. In use, two pairs of connecting portions 56*a* at opposite ends of the sliding plate 50*a* are positioned at the two pairs of positioning portions 18*a*. The positioning portions 18*a* protrude from the first sidewall 14*a* and the second sidewall 16*a*, requiring no defining slots at the first sidewall 14*a* and the second sidewall 16*a*, which both remain strong with minimal thickness.

The cavity filter 200 further includes three pairs of fixing portions 24*a* protruding from the first sidewall 14*a* and the second sidewall 16*a*. Each fixing portion 24*a* defines a threaded hole 242*a* at a tip of the fixing portion 24 and corresponds to a gap between a connecting portion 56*a* and an elastic arm 58*a* adjacent to the connecting portion 56*a*. Each pair of fixing portions 24*a* is placed between two resonators (not shown) to form a coupling window 244*a*, thereby avoiding the interference of the two resonators. The cover (not shown) is securely fixed to the fixing portions 24*a*, preventing movement of the cover and thereby increasing precision of the cavity filter 200.

Figure 7:
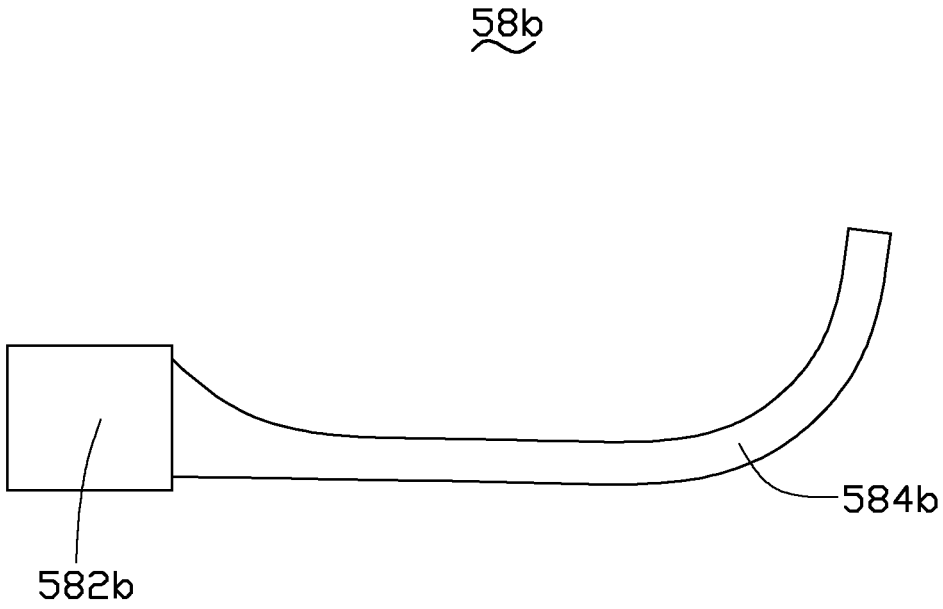
FIG. 7 is a side view of an elastic arm of a third embodiment of a cavity filter.

Referring to FIG. 7, a third embodiment of a cavity filter 300 differs from the first embodiment of the cavity filter 100 only in that an end of the arm portion 584*b* of the elastic arm 58*b* away from the fixing end 582*b* is curved to improve the elasticity of the elastic arm 85*b*, such that the elastic arm 58*b* may maintain good contact with the cover (not shown).

It is believed that the present embodiments and their advantages will be understood from the foregoing description, and it will be apparent that various changes may be made thereto without departing from the spirit and scope of the disclosure or sacrificing all of its material advantages.

What is claimed is:

1. A cavity filter, comprising:

a housing having an opening, the housing comprising at least one pair of positioning portions;

a plurality of resonators received in the housing;

a cover covering the opening;

a plurality of tuning posts fixed in the cover corresponding to the plurality of resonators; and a sliding plate disposed between the cover and the plurality of resonators, wherein the sliding plate is slidably positioned at the at least one pair of positioning portions, the sliding plate comprises a plurality of tuning cells, a plurality of connecting portions connecting the plurality of tuning cells in series, and at least one elastic arm, the plurality of tuning cells are coated with a metallic layer and correspond to the plurality of resonators, each of the plurality of tuning cells is positioned between two pairs of the plurality of connecting portions, and the at least one elastic arm extends from the sliding plate and elastically resists the cover.

2. The cavity filter of claim 1, wherein each elastic arm comprises a fixing end fixed to the sliding plate, an arm portion extending from the fixing end, and a resisting end resisting the cover and positioned at an end of the arm portion away from the fixing end.

3. The cavity filter of claim 2, wherein the resisting end extends out from the arm portion.

4. The cavity filter of claim 1, wherein each elastic arm comprises a fixing end fixed to the sliding plate, an arm portion extending from the fixing end, and a distal end of the arm portion away from the fixing end is curved and resists the cover.

5. The cavity filter of claim 1, wherein the housing comprises a first sidewall, a second sidewall opposite to the first sidewall, and at least one fixing portion protruding from an inner surface of the first sidewall or the second sidewall, and the cover is fixed to the at least one fixing portion.

6. The cavity filter of claim 1, wherein the housing comprises a first sidewall, a second sidewall opposite to the first sidewall, and at least one pair of fixing portions, each pair of fixing portions protruding from an inner surface of the first sidewall and the second sidewall and located between two resonators to form a coupling window.

7. The cavity filter of claim 1, wherein the plurality of connecting portions are distributed symmetrically relative to a line passing through the geometric centers of the plurality of tuning cells.

8. The cavity filter of claim 1, wherein the at least one elastic arm comprises a plurality of elastic arms distributed symmetrically relative to a line passing through the geometric centers of the plurality of tuning cells.

9. The cavity filter of claim 1, wherein the housing comprises a first sidewall and a second sidewall opposite to the first sidewall, each pair of positioning portions are a pair of slots depressed from inner surfaces of the first sidewall and the second sidewall respectively, two opposite sides of the sliding plate are partly received in the corresponding positioning portions.

10. The cavity filter of claim 1, wherein the housing comprises a first sidewall and a second sidewall opposite to the first sidewall, each pair of positioning portions protrude from inner surfaces of the first sidewall and the second sidewall respectively, and opposite sides of the sliding plate are positioned on the corresponding positioning portions.

* * * * *